US006672569B2

(12) United States Patent
Deeley

(10) Patent No.: US 6,672,569 B2
(45) Date of Patent: Jan. 6, 2004

(54) SECURITY FENCE WITH IMPROVED RAIL

(75) Inventor: Geoffrey Thomas Deeley, West Midlands (GB)

(73) Assignee: Hadley Industries PLC (GB)

( * ) Notice: Subject to any disclaimer, the term of this patent is extended or adjusted under 35 U.S.C. 154(b) by 0 days.

(21) Appl. No.: 10/407,566

(22) Filed: Apr. 4, 2003

(65) Prior Publication Data

US 2003/0164484 A1 Sep. 4, 2003

Related U.S. Application Data

(63) Continuation of application No. PCT/GB02/00873, filed on Feb. 28, 2002.

(51) Int. Cl.[7] ..... E04H 17/00
(52) U.S. Cl. ..... 256/22; 256/65.01
(58) Field of Search ..... 256/11, 2, 3, 19, 256/21, 22, 59, 65.01, 24

(56) References Cited

U.S. PATENT DOCUMENTS

| | | | | |
|---|---|---|---|---|
| 191,468 A | * | 5/1877 | Richards | 256/2 |
| 225,717 A | * | 3/1880 | Orwig | 256/2 |
| 4,143,857 A | | 3/1979 | Weiner | |
| 5,441,240 A | | 8/1995 | Arnold | |

FOREIGN PATENT DOCUMENTS

| | | |
|---|---|---|
| CH | 690826 | 1/2001 |
| DE | 19735507 | 11/1998 |
| GB | 311111 | 5/1929 |
| GB | 398750 | 9/1933 |
| GB | 2026126 | 1/1980 |
| GB | 2094368 | 9/1982 |
| GB | 2129845 | 5/1984 |
| GB | 2291081 | 1/1996 |
| GB | 2298439 | 9/1996 |
| GB | 2307253 | 5/1997 |
| GB | 2350846 | 12/2000 |
| WO | WO 00/04257 | 1/2000 |

* cited by examiner

*Primary Examiner*—John R. Cottingham
(74) *Attorney, Agent, or Firm*—Caesar, Rivise, Bernstein, Cohen & Pokotilow, Ltd.

(57) ABSTRACT

A security fence has a horizontal rail to which pales are connected and are spaced apart along the rail. The rail is shaped so that it cannot be used as a stepping surface for an intruder.

4 Claims, 1 Drawing Sheet

SECURITY FENCE WITH IMPROVED RAIL

This application is a continuing application under 35 U.S.C. §365(c) and 35 U.S.C. §120 of International Patent Application No. PCT/GB02/00873, filed on Feb. 28, 2002, and claims priority from British Application Nos. GB 01.05102, filed Mar. 1, 2001 and 01.29710, filed Dec. 12, 2001, respectively.

The invention relates to a security fence. It is known to make such a fence to protect an establishment having articles to be kept secure.

In one known style of fence, spaced apart metal posts called pales are secured to one or more horizontal rails between end posts. The pales may have the profile of a V, a corrugated W or corrugated D. The rail usually an L-shaped thick metal section and the pales are secured to the rail by bolts passed through aligned holes in the vertical leg of the rail and the pales. Typically the pales are spaced about 50 mm apart, and the exposed flat surface of the other leg of the rail could be used as a step by an intruder. The rails are made of relatively thick metal sections for strength. This increases the cost of the rails. It is one object of this invention to provide a fence which avoids presenting an intruder with this step. It is another object of this invention to provide rails of sufficient strength for the purpose specified.

In one aspect the invention provides a security fence comprising generally vertical pales each secured by a bolt or the like to a generally horizontal rail, the pales being spaced apart along the rail with gaps in between, the rail comprising a length of shaped metal section having a thickness of about 2 mm to about 4 mm, the section comprising a main web and at least one side wall which is above the main web and extends at an angle so that the gap portions of the rail between pales cannot be used by an intruder as a step.

Preferably the rail is of substantially channel shaped section having opposite side walls which make the rail rigid despite its thinness.

In another aspect spikes are struck up from the upper side wall in the gaps, to act as an added deterrent to an intruder.

Preferably the pales abut the outer face of the web of the rail, and the side walls of the rail extend away from the rail on the side of the web remote from the pales.

Typically the pales extend a vertical distance above the horizontal rail.

The pales are secured to the rail by bolts passing through aligned holes, in the usual way.

In order that the invention may be well understood it will now be described with reference to the accompanying diagrammatic drawings, in which.

Figure 1:
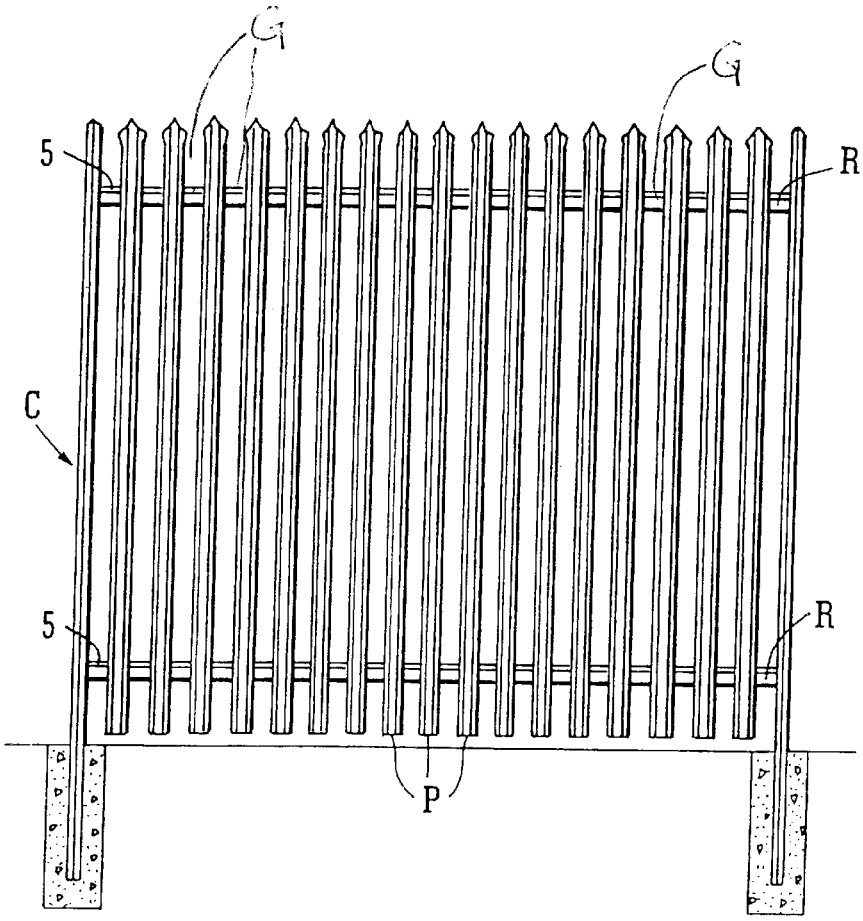
FIG. 1 is a front elevation of one security fence of the invention.
Figure 2:
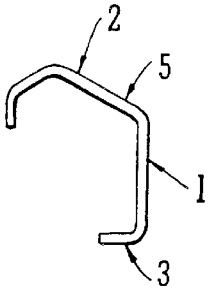
FIG. 2 is an end view of a rail shown in FIG. 1.
Figure 3:
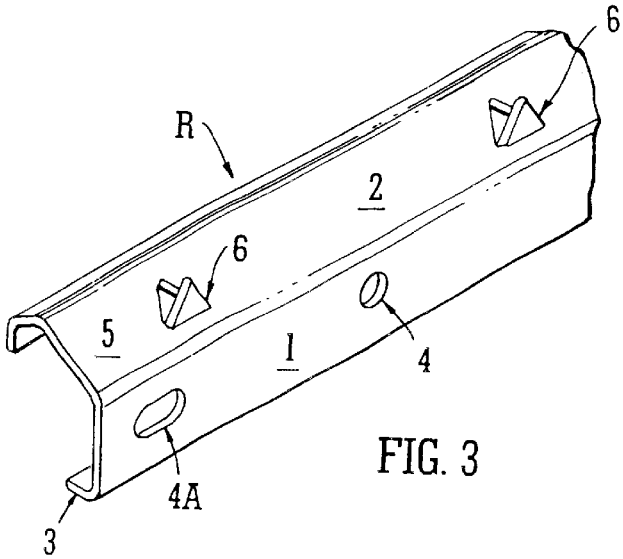
FIG. 3 is a perspective view from one end of another rail of the invention.

The security fence comprises spaced upright parallel pales P joined to an upper and lower horizontal rails R which are connected at their ends to end posts C. The pales extend beyond the upper rail. The pales P are spaced apart by a distance leaving gaps G in between. According to this invention at least the upper rail R is formed from cold rolled metal section, typically steel, to be of general channel shape comprising a main web 1 and opposite side walls 2,3. The section is from 2 to 4 mm thick, which is almost half the usual thickness of a hot rolled steel section rail. Fastener receiving holes 4 are formed at spaced apart locations in the main web 1 by which the pales P are secured thereto and holes 4*a* are present at each end for connection to the end posts C. The upper side wall 2 extends at an angle to define a ramp portion 5 to deter scaling of the assembly. The other side wall 3 is relatively short and straight. The dimensions of the section are selected to provide a predetermined yield strength. As shown in FIG. 3, spikes 6 are struck up from the floor of the ramp portion 5 to deter intruders from attempting to use the rail portions G as a step to gain access into the fenced area.

The pales P are rolled from metal section. They may be of any known shape and have fastener receiving holes.

In use, the rails R are secured between end posts C. The pales P are individually fastened onto the rail by aligning the fastening holes with the holes 4 in the rail and passing bolts, not shown, through and securing them in place by threading on nuts, not shown. The pales P are abutted against the face of the web 1 opposite to the side walls 2,3. The rail is sufficiently rigid to withstand distortion under load. The ramp portion 5 extends upwardly away from the pales into the secured area to prevent a thief from climbing over the fence by using the gap portion G as a step. The spikes 6 also act in this respect.

What is claimed is:

1. A security fence comprising two end posts, pales and at least one rail, wherein the pales are generally vertical and secured by bolt means to one side of a generally horizontal rail, the pales being spaced apart along the rail with gaps in between, the gaps being of sufficient width to enable an intruder to place his/her foot therein, the rail comprising a main web and at least one upper side wall, the main web of the rail having one vertical face which the pales abut, the at least one upper side wall of the rail extending outward and upward from the one vertical face of the main web at obtuse an angle to vertical, the angle being selected so that the gap portions of the rail between the pales cannot be used by an intruder as a step.

2. A fence according to claim 1, comprising spikes projecting up from the upper sidewall in the gaps between the pales.

3. A fence according to claim 1, wherein the pales extend a vertical distance above the horizontal rail.

4. A security fence comprising two end posts, pales and at least one rail, wherein the pales are generally vertical and secured by a bolt means to one side of generally horizontal rail, the pales being spaced apart along the rail with gaps in between, the gaps being of sufficient width to enable an intruder to place his/her foot therein, the rail comprising a length of shaped metal section having a wall thickness of about 2 mm to about 4 mm, the section comprising a main web and at least one side wall, the main web extending vertically and the sidewall extending outward and upward from the main web at an obtuse angle to vertical so that the gap portions of the rail between pales cannot be used by an intruder as a step.

* * * * *